US009347658B2

(12) United States Patent
Kwak et al.

(10) Patent No.: US 9,347,658 B2
(45) Date of Patent: May 24, 2016

(54) LIGHTING DEVICE

(71) Applicant: LG Innotek Co., Ltd., Seoul (KR)

(72) Inventors: Jae O Kwak, Seoul (KR); In Soo Park, Seoul (KR); Ki Hyun Kim, Seoul (KR); Min Hak Kim, Seoul (KR); Eun Hwa Kim, Seoul (KR); Hee Soo Lim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 17 days.

(21) Appl. No.: 14/258,851

(22) Filed: Apr. 22, 2014

(65) Prior Publication Data

US 2014/0313731 A1 Oct. 23, 2014

(30) Foreign Application Priority Data

Apr. 23, 2013 (KR) ..... 10-2013-0044792

(51) Int. Cl.

| | |
|---|---|
| ***F21S 4/00*** | (2006.01) |
| ***F21V 29/00*** | (2015.01) |
| ***F21K 99/00*** | (2016.01) |
| ***F21V 17/06*** | (2006.01) |
| ***F21V 17/10*** | (2006.01) |
| ***F21V 17/16*** | (2006.01) |
| ***F21V 29/70*** | (2015.01) |
| *F21Y 101/02* | (2006.01) |
| *F21Y 103/00* | (2016.01) |

(52) U.S. Cl.

CPC . *F21V 29/22* (2013.01); *F21K 9/17* (2013.01); *F21K 9/30* (2013.01); *F21V 17/06* (2013.01); *F21V 17/104* (2013.01); *F21V 17/164* (2013.01); *F21V 29/004* (2013.01); *F21V 29/70* (2015.01); *F21Y 2101/02* (2013.01); *F21Y 2103/003* (2013.01)

(58) Field of Classification Search

CPC ..... F21V 17/04; F21V 17/06; F21V 17/104; F21V 17/16; F21V 17/164; F21V 29/004; F21V 29/20; F21V 29/22; F21V 29/70; F21K 9/17; F21K 9/30; F21Y 2103/003

USPC ..... 362/217.01–217.17, 218–225, 249.02, 362/311.02

See application file for complete search history.

(56) References Cited

U.S. PATENT DOCUMENTS

| | | | | |
|---|---|---|---|---|
| 8,827,486 | B2 * | 9/2014 | Lai | F21K 9/175 362/218 |
| 2006/0146531 | A1 * | 7/2006 | Reo | F21S 4/008 362/244 |
| 2007/0076427 | A1 | 4/2007 | Reo et al. | |
| 2011/0141734 | A1 | 6/2011 | Li et al. | |
| 2011/0280010 | A1 | 11/2011 | Ou et al. | |

FOREIGN PATENT DOCUMENTS

| | | | |
|---|---|---|---|
| CN | 202158496 | U | 3/2012 |
| CN | 202371630 | U | 8/2012 |
| DE | 10 2008 025 182 | A1 | 12/2009 |
| DE | 10 2011 076 613 | A1 | 11/2012 |
| EP | 2 151 621 | A1 | 2/2010 |

* cited by examiner

*Primary Examiner* — Jason Moon Han

(74) *Attorney, Agent, or Firm* — Birch, Stewart, Kolasch & Birch, LLP

(57) ABSTRACT

A lighting device may be provided that comprises: a heat sink comprising a top surface and coupling structures which comprise a first coupling structure and a second coupling structure formed on a side surface of the heat sink; a light source disposed on the top surface of the heat sink; a lens unit disposed on the light source and comprising a first coupling portion which is coupled to the first coupling structure of the heat sink; and a cover unit comprising an optical member which is disposed on the lens unit, and a second coupling portion which is coupled to the second coupling structure of heat sink.

20 Claims, 7 Drawing Sheets

LIGHTING DEVICE

CROSS-REFERENCE TO RELATED APPLICATION

The present application claims priority under 35 U.S.C. §119 to Korean Patent Application No. 10-2013-0044792 filed Apr. 23, 2013 the subject matter of which is incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As the advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device that comprises: a heat sink comprising a top surface and coupling structures which comprise a first coupling structure and a second coupling structure formed on a side surface of the heat sink; a light source disposed on the top surface of the heat sink; a lens unit disposed on the light source and comprising a first coupling portion which is coupled to the first coupling structure of the heat sink; and a cover unit comprising an optical member which is disposed on the lens unit, and a second coupling portion which is coupled to the second coupling structure of heat sink.

Another embodiment is a lighting device that comprises: a heat sink comprising atop surface and a coupling structure formed on a side surface of the heat sink; a light source disposed on the top surface of the heat sink; a lens unit comprising a first coupling portion which is disposed on both sides of the lens unit; and a cover unit comprising an optical member which is disposed on the lens unit, a second coupling portion which is coupled to the coupling structure of the heat sink, and a guide which guides a top surface of the first coupling portion, wherein the top surface of the heat sink comprises a guide which guides a side of the first coupling portion and which is disposed between the second coupling portion and the guide of the cover unit.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'con' or "under" another element, it may be directly on/under the element, and/or one or more intervening elements may also be present. When an element is referred to as being 'on' or 'under', 'under the element' as well as 'on the element' may be comprised based on the element.

An embodiment may be described in detail with reference to the accompanying drawings.

Figure 1:
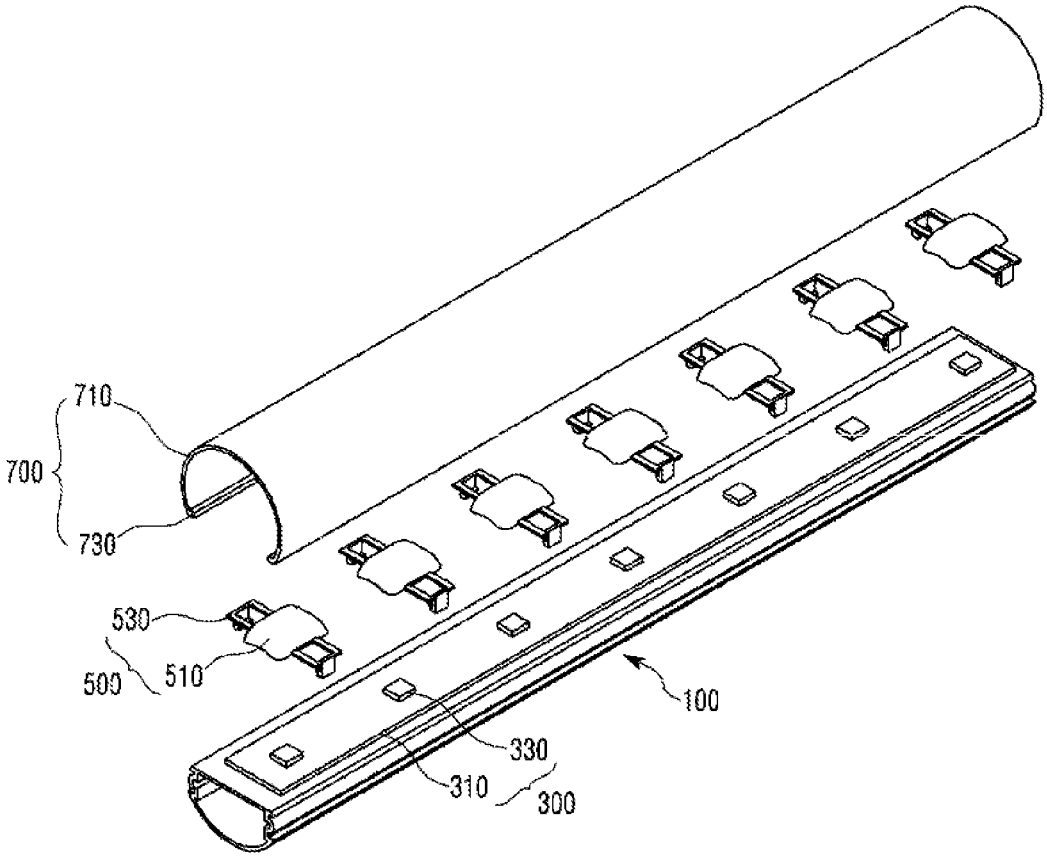
FIG. 1 is an exploded perspective view of lighting device according to an embodiment.
Figure 2:
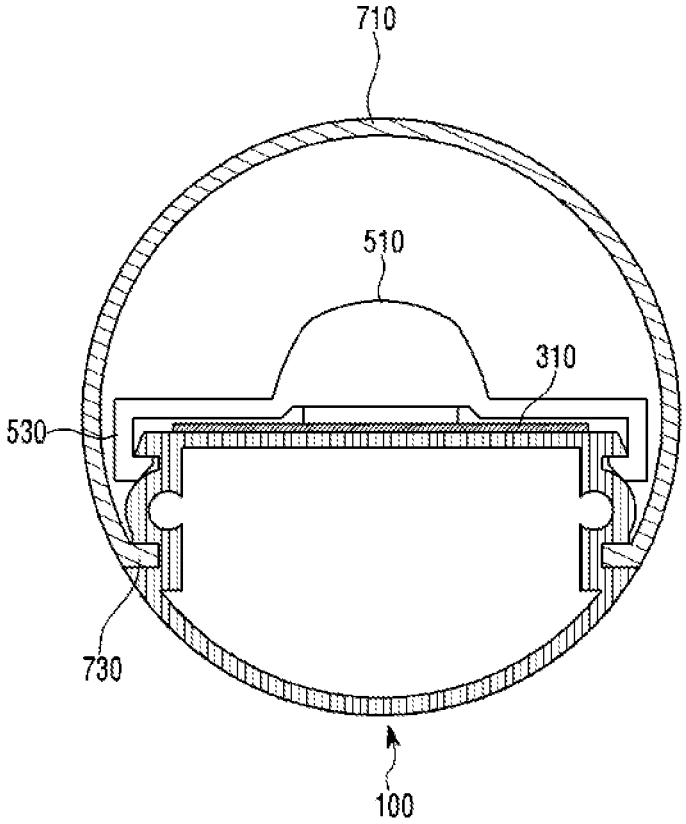
FIG. 2 is a cross sectional view of the lighting device shown in FIG. 1.
Figure 3:
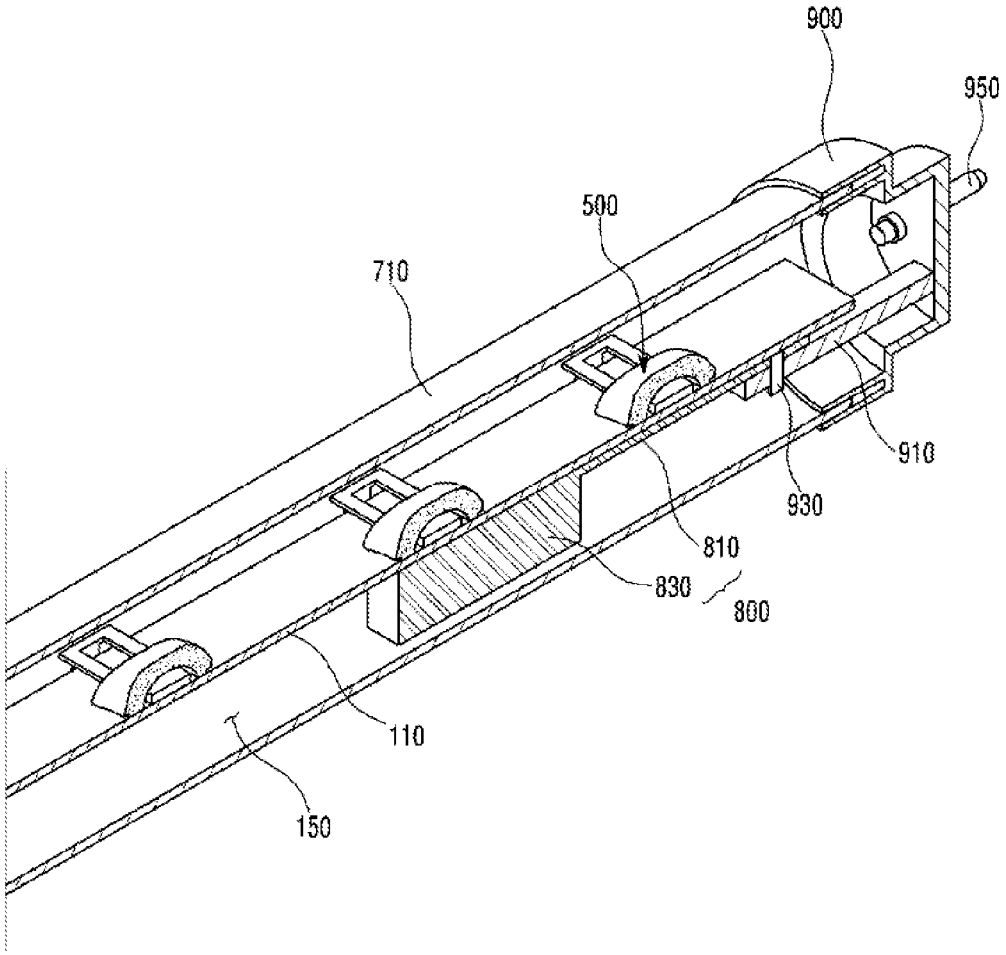
FIG. 3 is a cross sectional view of one end of both ends of the lighting device shown in FIG. 1.

FIG. 1 is an exploded perspective view of a lighting device according to an embodiment. FIG. 2 is a cross sectional view of the lighting device shown in FIG. 1. FIG. 3 is a cross sectional view of one end of both ends of the lighting device shown in FIG. 1.

Referring to FIGS. 1 to 3, the lighting device according to the embodiment may be a tube type lighting device capable of replacing an existing fluorescent lamp.

The lighting device according to the embodiment may comprise a heat sink 100, a light source 300, a lens unit 500 and a cover unit 700.

The heat sink 100 radiates outwardly heat emitted from the light source 300 and a power supplier 800.

The light source 300 and the power supplier 800 may be disposed on and in the heat sink 100. The heat sink 100 may be coupled to the lens unit 500 and the cover unit 700. Also, the heat sink 100 may be also coupled to a cap 900.

The heat sink 100 may have a consistent cross section in one direction. Here, the one direction may be a longitudinal direction of the heat sink 100.

The heat sink 100 may have a tubular shape with an empty interior. Also, the heat sink 100 may have bath open side ends thereof. The power supplier 800 may be disposed within the heat sink 100. Both side ends of the heat sink 100 may be coupled to the cap 900 respectively.

The heat sink 100 will be described in detail with reference to FIG. 4.

Figure 4:
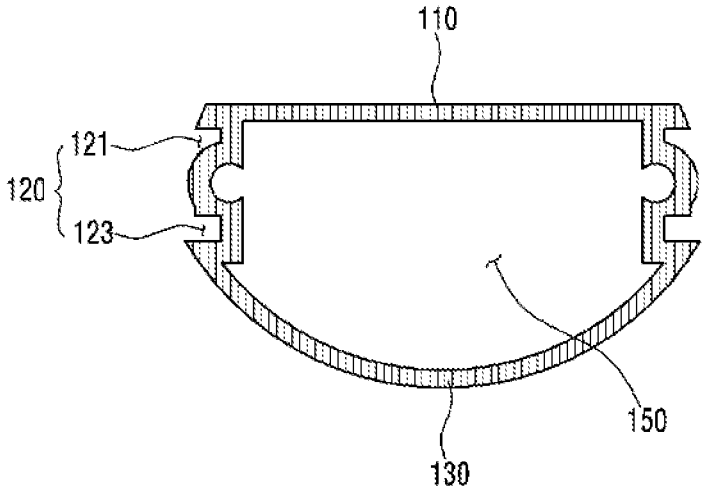
FIG. 4 is a cross sectional view of a heat sink 100 alone shown in FIG. 2.

FIG. 4 is a cross sectional view of a heat sink 100 alone shown in FIG. 2.

Referring to FIGS. 1 to 4, the heat sink 100 may comprise a top surface 110, a side surface 120, and a bottom surface 130. The top surface 110, the side surface 120, and the bottom surface 130 may define a receiver 150 of the heat sink 100.

The light source 300 is disposed on the top surface 110 of the heat sink 100. Specifically, a circuit pattern layer 310 and a kin emitting device 330 of the light source 300 may be disposed on the top surface 110 of the heat sink 100. The top surface 110 of the heat sink 100 may be flat. However, there is no limit to this. A portion of or entire top surface 110 may be upward or downward convex or concave.

The side surface 120 of the heat sink 100 is disposed between the top surface 110 and the bottom surface 130. Specifically, the side surface 120 is coupled to the top surface 110 and the bottom surface 130.

The side surface 120 of the heat sink 100 is coupled to the lens unit 500 and the cover unit 700. Specifically, the side surface 120 of the heat sink 100 may have a first coupling structure 121 and a second coupling structure 123 in order to be coupled to the lens unit 500 and the cover unit 700.

The first coupling structure 121 may be a first coupling recess, and the second coupling structure 123 may be a second coupling recess. The first coupling recess 121 and the second coupling recess 123 may be formed to a predetermined depth in the longitudinal direction of the heat sink 100 (one direction).

The first coupling recess 121 and the second coupling recess 123 may be formed in the side surface 120 of the heat sink 100 respectively. The first coupling recess 121 may be disposed on the second coupling recess 123.

The first coupling recess 121 is coupled to a coupling portion 530 of the lens unit 500. Specifically, the coupling portion 530 of the lens unit 500 may be inserted into the first coupling recess 121. Thanks to the first coupling recess 121, the lens unit 500 may be fixed on the light source 300 by no use of a separate coupling means, for example, a screw, a rivet or an adhesive, etc.

The second coupling recess 123 is coupled to a coupling portion 730 of the cover unit 700. Specifically, the coupling portion 730 of the cover unit 700 may be inserted into the second coupling recess 123. Through the second coupling recess 123, the cover unit 700 may be coupled to the heat sink 100 in a sliding manner.

The bottom surface 130 of the heat sink 100, together with the cover unit 700, may form the appearance of the lighting device according to the embodiment. The bottom surface 130 of the heat sink 100 is coupled to the cover unit 700, so that the lighting device according to the embodiment may have a cylindrical shape.

The bottom surface 130 of the heat sink 100 may have a predetermined curvature. However, there is no limit to this. The bottom surface 130 of the heat sink 100 may be flat like the top surface 110 of the heat sink 100.

Figure 7:
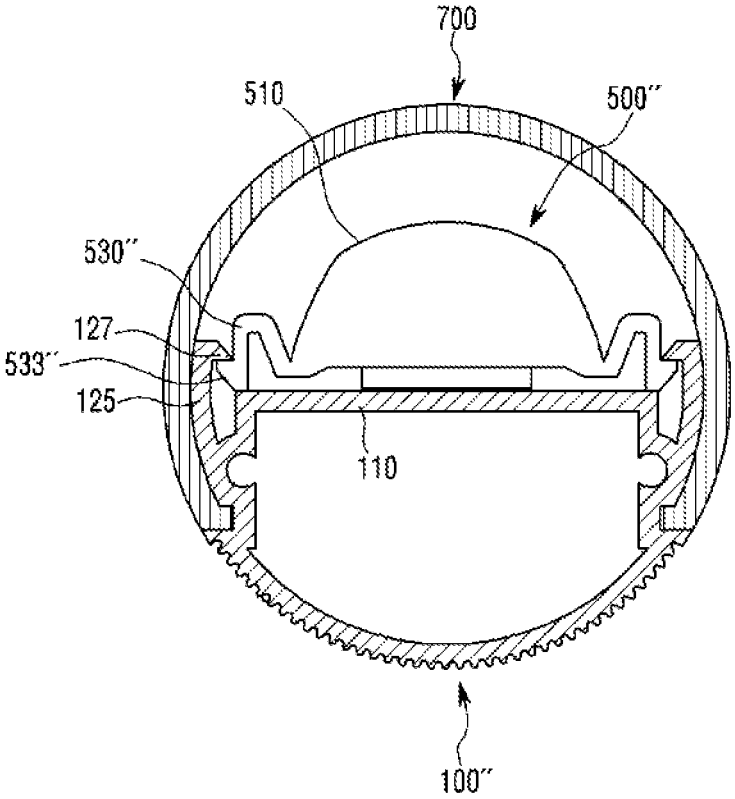
FIG. 7 is a cross sectional view of a lighting device according to further another embodiment.

For the purpose of increasing the outer surface area of the bottom surface 130, a plurality of heat radiating fins may be, as shown in FIG. 7, formed on the outer surface of the bottom surface 130 of the heat sink 100.

The receiver 150 of the heat sink 100 is an empty space. The power supplier 800 may be disposed in the receiver 150.

The heat sink 100 may be formed of a metallic material or a resin material which has excellent heat radiation efficiency. The heat sink 100 may have a thermal conductivity greater than 150 W/(mK). For example, the heat sink 100 may be formed of copper having a thermal conductivity of about 400 W/(mK), aluminum having a thermal conductivity of about 250 W/(mK), anodized aluminum, an aluminum alloy, and a magnesium alloy. Also, the heat sink 100 may be formed of a metal loaded plastic material like polymer, for example, epoxy or a thermally conductive ceramic material (e.g., aluminum silicon carbide (AlSiC), having a thermal conductivity of from about 170 to 200 W/(mK)).

Referring back to FIGS. 1 to 3, the light source 300 is disposed on the heat sink 100. Specifically, the light source 300 may be disposed on the outer surface of the top surface 110 of the heat sink 100.

The light source 300 may comprise the circuit pattern layer 310 and the light emitting device 330.

The circuit pattern layer 310 may be disposed on the outer surface of the top surface 110 of the heat sink 100, and a plurality of the light emitting devices 330 may be disposed on the circuit pattern layer 310. The plurality of the light emitting devices 330 may be disposed separately from each other by a regular interval on the circuit pattern layer 310.

The circuit pattern layer 310 is electrically connected to and supplies electric power to the plurality of the light emitting devices 330.

The circuit pattern layer 310 may be formed by printing a circuit pattern on an insulator. For example, the circuit pattern layer 310 may be a printed circuit board (PCB), FR-4 PCB (epoxy resin), a metal core PCB, a flexible PCB, a ceramic PCB and the like.

Also, the circuit pattern layer 310 may be formed by printing a circuit pattern on a transparent or opaque resin. Here, the resin may be a thin insulating sheet having the circuit pattern.

The top surface of the circuit pattern layer 310 is a surface on which the light emitting device 330 is disposed. The top surface of the circuit pattern layer 310 may be formed of a material capable of efficiently reflecting light or may be coated with a color capable of efficiently light, for example, white, silver, etc.

The plurality of the light emitting devices 330 may be arranged in a row on the top surface of the circuit pattern layer 310.

The light emitting device 330 may be a light emitting diode chip emitting light in a range of visible light such as yellow, red, green, blue and white lights, etc., or may be a light emitting diode chip emitting ultraviolet light in a range of ultraviolet. Here, the light emitting diode chip may have a lateral type, a vertical type or a flip type.

The light emitting device 330 may be a high-voltage (HV) LED package. A HV LED chip in the HV LED package has a plurality of divided light emitting areas therein. The respective light emitting areas are electrically connected to electrodes. The light emitting device 330 is driven depending to the arrangement of the light emitting areas. The light emitting device 330 is driven an AC or DC power supplier and is driven by a voltage higher than that of a light emitting device having a single light emitting area. In general, the light emitting device 330 is driven by applying a voltage greater than the product of a driving voltage of a single chip and the number of the light emitting devices. Further, the HV LED package comprises a plurality of the internal light emitting areas, and thus, has a high power consumption of about 1 W.

In the light emitting device 330, the power consumption is in proportion to the light intensity. Therefore, through use of the HV LED packages of which the number is ⅕ to ½ as many as the number of conventional LED packages, it is possible to manufacture a lighting device having the level equivalent to that of the conventional LED package. By using the HV LED package in this manner, the number of the light emitting devices can be reduced more than that of the general LED packages. Accordingly, a production cost of the lighting device according to the embodiment can be reduced.

The lens unit 500 may be disposed on the light source 300 and diffuse light emitted from the light emitting device 330. Also, the lens unit 500 may be stably fixed on the light source 300 by being coupled to the heat sink 100.

The number of the lens units 500 may correspond to the number of the light emitting devices 330. Specifically, a plurality of the lens units 500 may one-to-one or one-to-many correspond to the plurality of the light emitting devices 330.

That is, one lens unit 500 may be coupled to the heat sink 100 in response to one light emitting device 330 or many light emitting devices 330. The lens unit 500 causes the reduction of the number of the light emitting devices 330, so that the production cost of the lighting device according to the embodiment can be reduced.

The lens unit 500 will be described in detail with reference to FIGS. 1 and 5.

Figure 5:
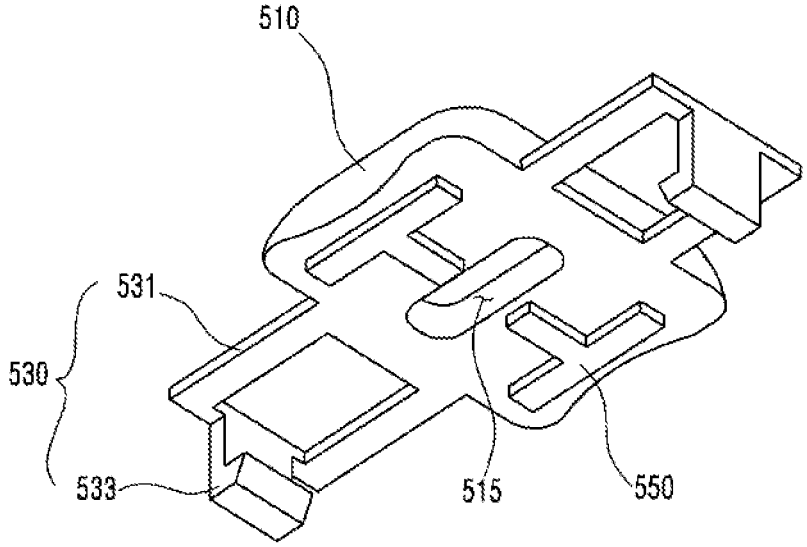
FIG. 5 is a bottom perspective view of a lens unit 500 shown in FIG. 1.

FIG. 5 is a bottom perspective view of the lens unit 500 shown in FIG. 1.

Referring to FIGS. 1 to 5, the lens unit 500 may comprise a diffuser 510, the coupling portion 530, and a guide 550.

The diffuser 510 of the lens unit 500 is disposed on the light emitting device 330 of the light source 300 and may diffuse the light emitted from the light emitting device 330. Here, the diffuser 510 uniformly diffuses the light emitted from the light emitting device 330 in forward and lateral directions, thereby improving the unformity of light omitted from the cover unit 700.

The bottom surface of the diffuser 510 may have a recess 515 into which the light emitting device 330 is inserted.

The diffuser 510 may be formed of a light transmitting resin such as a silicone resin or an epoxy resin.

The diffuser 510 may comprise a wholly or partially distributed phosphor. When the light emitting device 330 is a blue light emitting diode, the phosphor comprised in the diffuser 510 may comprise at least one of garnet based phosphor (YAG, TAG), silicate based phosphor, nitride based phosphor and oxynitride based phosphor.

It is possible to create natural sunlight (white light) by comprising only yellow phosphor to the diffuser 510. Additionally, green phosphor or red phosphor may be further comprised in order to improve a color rendering index and to reduce a color temperature.

When many kinds of fluorescent materials are mixed in the diffuser 510, an addition ratio of the color of the phosphor may be formed such that the green phosphor is more used than the red phosphor, and the yellow phosphor is more used than the green phosphor. The garnet phosphor (YAG), the silicate phosphor and the oxynitride phosphor may be used as the yellow phosphor. The silicate phosphor and the oxynitride phosphor may be used as the green phosphor. The nitride phosphor may be used as the red phosphor. The diffuser 510 may be mixed with various kinds of the phosphors or may be configured by a layer comprising the red phosphor, a layer comprising the green phosphor and a layer comprising the yellow phosphor, which are formed separately from each other.

The coupling portion 530 of the lens unit 500 is coupled to the heat sink 100. Specifically, the coupling portion 530 may be coupled to the first coupling recess 121 of the heat sink 100. The coupling portion 530 may be disposed on both sides of the diffuser 510 so as to be coupled to the two side surfaces 120 of the heat sink 100 respectively. After the first coupling portion 530 disposed on one side of the diffuser 510 is coupled to the first coupling recess 121 formed in the first side surface 120 of the heat sink 100, a second coupling portion disposed on the other side of the diffuser 510 is coupled to the first coupling recess formed in a second side surface of the heat sink 100.

The coupling portion 530 may comprise an extension part 531 and a hook 533.

The extension part 531 may be formed extending from one side of the diffuser 510. The hook 533 may be formed extending from an end of the extension part 531. The extension part 531 may be disposed on the top surface 110 of the heat sink 100, and the hook 533 may be inserted into the first coupling recess 121 of the heat sink 100. By means of the coupling portion 530, the diffuser 510 can be fixed on the light emitting device 330.

The guide 550 of the lens unit 500 may be disposed on the bottom surface of the diffuser 510. The guide 550 may protrude downwardly from the bottom surface of the diffuser 510. The guide 550 guides the both sides of the light emitting device 330, causing the diffuser 510 to be fixed at a correct position on the light emitting device 330.

The diffuser 510 can be firmly fixed by using the coupling portion 530 and the guide 550 at the same time. Specifically, the two coupling portions 530 prevent the diffuser 510 from moving in a direction perpendicular to the longitudinal direction of the heat sink 100, the two guides 550 prevent the diffuser 510 from moving in the longitudinal direction of the heat sink 100. As a result, the diffuser 510 can be firmly fixed on the light emitting device 330.

Referring back to FIGS. 1 to 3, the cover unit 700 forms the appearance of the lighting device according to the embodiment by being coupled to the heat sink 100.

As with the heat sink 100, the cover unit 700 may have a consistent cross section in one direction.

The cover unit 700 may comprise an optical member 710 and a coupling portion 730.

The optical member 710 may have a partial opening cylindrical shape. Here, the heat sink 100 is disposed in the partial opening.

The optical member 710 may allow the light omitted from the lens unit 500 to pass therethrough as it is. Also, the optical member 710 may scatter or excite the light emitted from the lens unit 500.

An opalescent pigment may be coated on the inner surface of the optical member 710 or may be comprised in the inside of the optical member 710. The opalescent pigment may comprise a diffusing agent diffusing the light. The surface roughness of the inner surface of the optical member 710 may be lamer than that of the outer surface of the optical member 710. This intends to sufficiently scatter and diffuse the light from the lens unit 500, and then to outwardly emit the light.

The coupling portion 730 may be formed to protrude inwardly from both sides which form the opening of the optical member 710. The coupling portion 730 may be coupled to the second coupling recess 123 of the heat sink 100 shown in FIG. 4. The coupling portion 730 may be inserted into the second coupling recess 123 in a sliding manner.

The cover unit 700 may be formed of any one of glass, plastic, polypropylene (PP), polyethylene (PE), polycarbonate (PC) or the like. Here, the polycarbonate (PC) has excellent light resistance, thermal resistance and rigidity.

The cover unit 700 may be formed of a transparent material causing the lens unit 500 to be visible to the outside or may be formed of an opaque material.

As shown in FIG. 3, the lighting device according to the embodiment may further comprise the power supplier 800 and the cap 900.

The power supplier 800 may comprise a support plate 810 and a predetermined part 830 which is disposed on the support plate 810. The part 830 may comprise, for example, a DC converter converting AC power supply supplied by an external power supply into DC power supply, a driving chip controlling the driving of the light source 300, and an electrostatic discharge (ESD) protective device for protecting the light source 300. However, there is no limit to this.

The cap 900 may be disposed on both sides of the heat sink 100 and on both sides of the cover unit 700 respectively. Specifically, the cap 900 may be coupled to both sides of the mutually coupled the heat sink 100 and cover unit 700.

The cap 900 may comprise a fixing portion 910. The fixing portion 910 may protrude toward the receiver 150 of the heat sink 100 from the inside of the cap 900. The fixing portion 910 may have a predetermined hole formed therein through which a screw 930 passes. The screw 930 is coupled to the hole, so that the power supplier 800 is coupled to the cap 900.

The cap 900 may have a pin 950 comprised in an existing fluorescent lamp, for the purpose of replacing the existing fluorescent lamp. The shape and size of the pin 950 may depend on the standard of the pin of the existing fluorescent lamp.

The power supplier 800 may be coupled to the cap 900 and be disposed within the receiver 150 of the heat sink 100. Specifically, the support plate 810 of the power supplier 800 is coupled to the fixing portion 910 of the cap 900 through the screw 930. As a result, the fixing portion 910 can be fixed to the inside of the receiver 150 of the heat sink 100.

Figure 6:
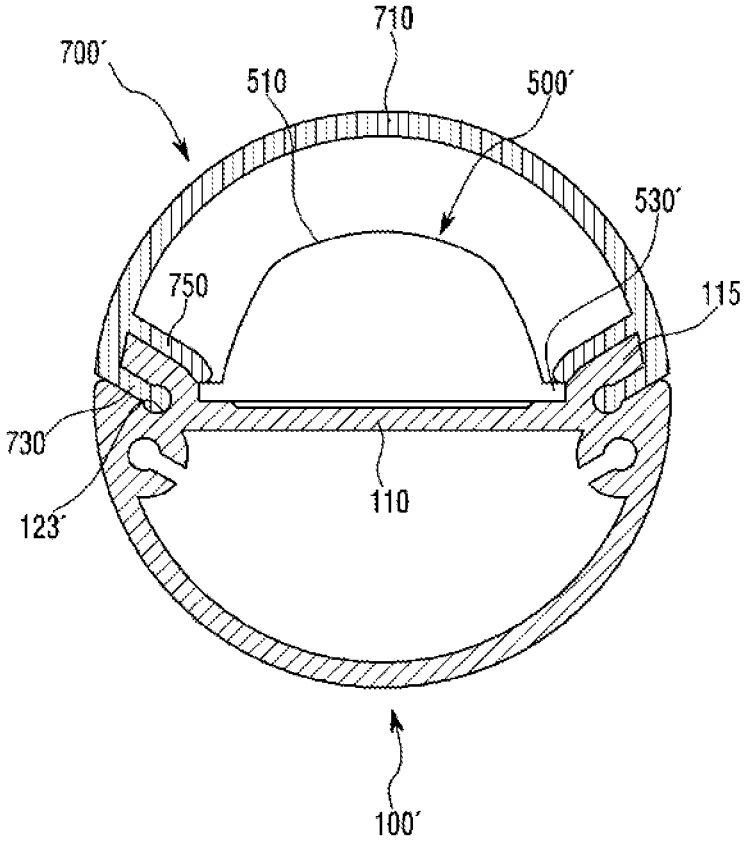
FIG. 6 is a cross sectional view of a lighting device according to another embodiment.

FIG. 6 is a cross sectional view of a lighting device according to another embodiment.

The heat sink, the lens unit, and the cover unit of the lighting device shown in FIG. 6 are different from those of the lighting device shown in FIGS. 1 to 3. Hereafter, the lighting device according to another embodiment will be described focusing on the differences.

Referring to FIG. 6, a heat sink 100' may have the top surface 110 on which a light source (not shown) and a lens unit 500' are disposed, and a coupling recess 123' which is coupled to a cover unit 700'.

The top surface 110 may comprise a guide 115 which guides the side of a coupling portion 530' of the lens unit 500'. The guide 115 may be disposed between a coupling portion 730 of the cover unit 700' and a guide 750 of the cover unit 700'. The guide 115 may protrude toward the cover unit 700' from the top surface 110.

The cover unit 700' may comprise the optical member 710, the coupling portion 730 and the guide 750. Although the shapes of the optical member 710 and the coupling portion 730 area little bit different from the shapes of the optical member 710 and the coupling portion 730 shown in FIG. 2, functions of the optical member 710 and the coupling portion 730 are the same as those of the optical member 710 and the coupling portion 730 shown in FIG. 2. Therefore, detailed description thereof will be omitted.

The guide 750 guides the top surface of the coupling portion 530' of the lens unit 500'. The guide 750 protrudes from the inner surface of the optical member 710. The end of the guide 750 may be disposed on the top surface of the coupling portion 530' of the lens unit 500'. Due to the guide 750, the lens unit 500' may be prevented from moving on the heat sink 100'

When the guide 115 of the heat sink 100' and the guide 750 of the cover unit 700' are simultaneously employed, the lens unit 500' can be more firmly fixed. Particularly, when the cover unit 700' is coupled to the heat sink 100' in a sliding manner after the lens unit 500' is installed on the heat sink. 100', the guide 750 of the cover unit 700' is able to automatically guide the coupling portion 530' of the lens unit 500'.

Figure 8:
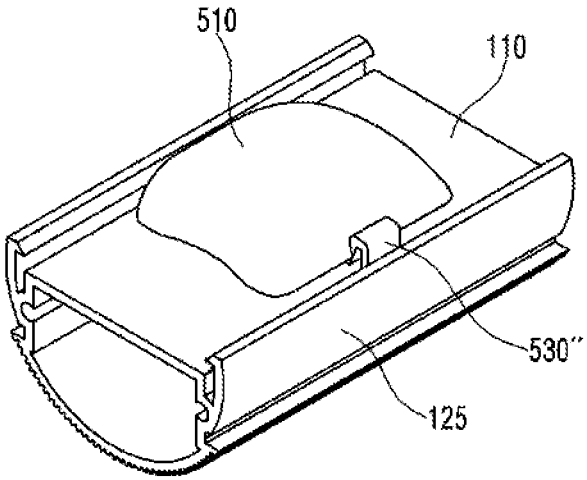
FIG. 8 is a perspective view of the lighting device shown in FIG. 7 without a cover unit 700.
Figure 9:
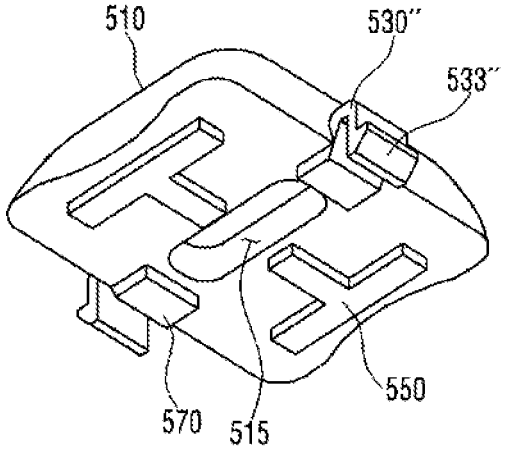
FIG. 9 is a bottom perspective view of a lens unit 500" shown in FIG. 7.

FIG. 7 is a cross sectional view of a lighting device according to further another embodiment. FIG. 8 is a perspective view of the lighting device shown in FIG. 7 without a cover unit 700. FIG. 9 is a bottom perspective view of a lens unit 500" shown in FIG. 7.

The heat sink and the lens unit of the lighting device shown in FIGS. 7 to 9 are different from those of the lighting device shown in FIGS. 1 to 3. Hereafter, the lighting device according to further another embodiment will be described focusing on the differences.

Referring to FIGS. 7 to 9, a heat sink 100" may comprise a guide 125. The guide 125 may protrude on the top surface 110 of the heat sink 100" from the side surface of the heat sink 100". The outer surface of the guide 125 guides the optical member of the cover unit 700, and thus, the cover unit 700 may be stably coupled to the heat sink 100" in a sliding manner. A coupling recess similar to the first coupling recess 121 shown in FIG. 4 is may be formed between the guide 125 and the side surface. The coupling recess may be coupled to a coupling portion 530" of the lens unit 500".

The guide 125 of the heat sink 100" may have a hook 127 which is coupled to the coupling portion 530" of the lens unit 500". The hook 127 may protrude toward the side of the lens unit 500" from the end of the guide 125.

The lens unit 500" may comprise the coupling portion 530" which is coupled between the hook 127 of the heat sink 100" and the top surface 110 of the heat sink 100". The coupling portion 530" may have a hook 533" corresponding to the hook 127 of the heat sink 100". The hook 533" may be inserted and fixed between the hook 127 of the heat sink 100" and the top surface 110 of the heat sink 100".

The lens unit 500" may comprise guides 550 and 570. Since the first guide 550 is the same as the guide 550 shown in FIG. 5, a detailed description thereof will be omitted. The second guide 570 may be disposed on the bottom surface of the diffuser 510 and may guide, together with the first guide 550, a light emitting device (not shown). Specifically, the first guide 550 may guide one pair of mutually facing sides among four sides of the light emitting device, and the second guide 570 may guide the other pair of the sides.

Any reference in this specification to "one embodiment," "an embodiment," "example embodiment," etc., means that a particular feature, structure, or characteristic described in connection with the embodiment is comprised in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a heat sink comprising a top surface, a bottom surface disposed below the top surface and coupling structures which comprise a first coupling structure and a second coupling structure formed on a side surface disposed between the top surface and the bottom surface, the side surface connecting the top surface and the bottom surface;

a light source disposed on the top surface of the heat sink;

a lens unit disposed on the light source and comprising a first coupling portion which is coupled to the first coupling structure formed on the side surface of the heat sink; and a cover unit comprising an optical member which is disposed on the lens unit, and a second coupling portion which is coupled to the second coupling structure formed on the side surface of heat sink.

2. The lighting device of claim 1, wherein the side surface is coupled to both sides of the top surface respectively.

3. The lighting device of claim 2, wherein the first and second coupling structures are a recess, and wherein a distance from the top surface to the second coupling structure is greater than a distance from the top surface to the first coupling structure.

4. The lighting device of claim 1, wherein the first coupling portion of the lens unit comprises:

an extension part which is coupled to both sides of the lens unit and is disposed on the top surface of the heat sink; and a hook which is coupled to the extension part and is inserted into the first coupling structure of the heat sink.

5. The lighting device of claim 1, wherein the light source comprises a circuit pattern layer disposed on the top surface of the heat sink, and a light emitting device disposed on the circuit pattern layer.

6. The lighting device of claim 5, wherein the light emitting device comprises a high-voltage (HV) LED chip, and wherein the HV LED chip has a plurality of light emitting areas.

7. The lighting device of claim 5, wherein the lens unit comprises a diffuser which is disposed on the light emitting device and diffuses light emitted from the light emitting device, and wherein a bottom surface of the diffuser has a recess into which the light emitting device is inserted.

8. The lighting device of claim 7, wherein the lens unit further comprises a guide which is disposed on a bottom surface of the diffuser and guides the light emitting device.

9. The lighting device of claim 1, wherein the light source comprises a light emitting device, wherein a plurality of the light emitting devices and a plurality of the lens units are provided, and wherein the plurality of the lens units are one-to-one or one-to-many correspond to the plurality of the light emitting devices.

10. The lighting device of claim 1, further comprising:

a power supplier received in a space formed in the heat sink; and a cap which is coupled to both sides of the heat sink and to both sides of the cover unit and comprises a fixing portion for fixing the power supplier within the space of the heat sink.

11. The lighting device of claim 10, wherein the fixing portion of the cap protrudes into the space of the heat sink, wherein the power supplier comprises predetermined parts and a support plate on which the parts are mounted, and wherein the support plate is coupled to the fixing portion through a screw.

12. A lighting device comprising:

a heat sink having a consistent cross section in a longitudinal direction and comprising a top surface, a bottom surface disposed below the top surface and both side surfaces disposed between the top surface and the bottom surface, each of the side surfaces connecting the top surface and the bottom surface and having a first coupling recess and a second coupling recess which are formed toward the longitudinal direction;

a light source disposed on the top surface of the heat sink;

a lens unit covering the light source and comprising a first coupling portion which is coupled to the first coupling recess of the heat sink; and a cover unit comprising an optical member covering the lens unit, and a second coupling portion which is coupled to the second coupling recess of the heat sink.

13. The lighting device of claim 12, wherein the heat sink has a tubular shape with an empty interior.

14. The lighting device of claim 12, wherein at least a portion of the top surface is upward or downward convex or concave.

15. The lighting device of claim 12, wherein the heat sink comprises the bottom surface, and wherein the bottom surface is coupled to the cover unit, so that the lighting device has a cylindrical shape.

16. The lighting device of claim 15, wherein the top surface, the both side surfaces and the bottom surface define a receiver, and wherein the lighting device comprises a power supplier disposed in the receiver.

17. The lighting device of claim 12, wherein the first coupling portion of the lens unit comprises:

an extension part which is coupled to both sides of the lens unit and is disposed on the top surface of the heat sink; and a hook which is coupled to the extension part and is inserted into the first coupling recess of the heat sink.

18. The lighting device of claim 12, wherein the light source comprises a circuit pattern layer disposed on the top surface of the heat sink, and a light emitting device disposed on the circuit pattern layer.

19. The lighting device of claim 18, wherein the light emitting device comprises a high-voltage (HV) LED chip, and wherein the HV LED chip has a plurality of light emitting areas.

20. The lighting device of claim 18, wherein the lens unit comprises a diffuser which is disposed on the light emitting device and diffuses light emitted from the light emitting device, and wherein a bottom surface of the diffuser has a recess into which the light emitting device is inserted.

* * * * *